US009508520B2

(12) United States Patent
Patti

(10) Patent No.: US 9,508,520 B2
(45) **Date of Patent: *Nov. 29, 2016**

(54) INTEGRATED VACUUM MICROELECTRONIC DEVICE AND FABRICATION METHOD THEREOF

(71) Applicant: STMicroelectronics S.r.l., Agrate Brianza (IT)

(72) Inventor: Davide Giuseppe Patti, Mascalucia (IT)

(73) Assignee: STMICROELECTRONICS S.R.L., Agrate Brianza (IT)

( * ) Notice: Subject to any disclaimer, the term of this patent is extended or adjusted under 35 U.S.C. 154(b) by 16 days.

This patent is subject to a terminal disclaimer.

(21) Appl. No.: 14/290,583

(22) Filed: May 29, 2014

(65) Prior Publication Data

US 2014/0353576 A1 Dec. 4, 2014

(30) Foreign Application Priority Data

May 31, 2013 (IT) ..... MI2013A0897

(51) Int. Cl.
*H01J 1/304* (2006.01)
*H01J 9/02* (2006.01)
*H01J 21/10* (2006.01)

(52) U.S. Cl.
CPC ..... *H01J 1/3044* (2013.01); *H01J 9/025* (2013.01); *H01J 9/027* (2013.01); *H01J 21/105* (2013.01)

(58) Field of Classification Search
CPC ..... H01J 1/3044
See application file for complete search history.

(56) References Cited

U.S. PATENT DOCUMENTS

| | | | | |
|---|---|---|---|---|
| 5,163,328 | A | 11/1992 | Holland et al. | |
| 5,249,340 | A | 10/1993 | Kane et al. | |
| 5,358,909 | A * | 10/1994 | Hashiguchi | H01J 9/025 216/11 |
| 5,463,269 | A | 10/1995 | Zimmerman | |
| 5,603,649 | A | 2/1997 | Zimmerman | |
| 5,795,208 | A * | 8/1998 | Hattori | H01J 9/025 445/24 |
| 6,252,340 | B1 | 6/2001 | Hattori | |
| 2001/0010649 | A1 | 8/2001 | Lu | |

FOREIGN PATENT DOCUMENTS

| | | | |
|---|---|---|---|
| CN | 1327610 | A | 12/2001 |
| DE | 4112436 | A1 | 11/1992 |
| DE | 4224519 | A1 | 1/1994 |
| EP | 0501785 | A2 | 9/1992 |

OTHER PUBLICATIONS

Chinese Search Report, dated Aug. 22, 2016, for Chinese Application No. 2014102417457, 2 pages.

* cited by examiner

*Primary Examiner* — Daniel Luke
(74) *Attorney, Agent, or Firm* — Seed IP Law Group LLP

(57) ABSTRACT

An integrated vacuum microelectronic device comprises: a highly doped semiconductor substrate, at least one insulating layer) placed above said doped semiconductor substrate, a vacuum aperture formed within said at least one insulating layer and extending to the highly doped semiconductor substrate, a first metal layer acting as a cathode, a second metal layer placed under said highly doped semiconductor substrate and acting as an anode. The first metal layer is placed adjacent to the upper edge of the vacuum aperture and the vacuum aperture has a width dimension such as the first metal layer remains suspended over the vacuum aperture.

24 Claims, 14 Drawing Sheets

INTEGRATED VACUUM MICROELECTRONIC DEVICE AND FABRICATION METHOD THEREOF

BACKGROUND

Technical Field

The present disclosure relates to an integrated vacuum microelectronic device and fabrication method thereof.

Description of the Related Art

The vacuum tube, once one of the mainstays of electronics, had limitations such as the mechanically fabricated structure inside the glass envelope, preventing miniaturization and integration. For this reason, in the era of systems on chip, it has been gradually supplanted by transistors.

However, in the last years semiconductor fabrication techniques have been used to develop vacuum tube structures in micro miniature form and integrate many of them together. The integrated Vacuum Microelectronic Devices (VMD) have several unique features; they have sub-picosecond switching speeds, operate at temperatures ranging from near absolute zero to hundreds of degrees Celsius, are also very efficient because control is by charge and not by current flow and do not need thermionic emission heaters like in the traditional vacuum discrete devices.

In summary a typical field emission VMD device is made up of a sharply pointed cathode, surrounded by one or more control and/or extraction electrodes, and pointing toward an anode surface. When an appropriate positive potential difference is applied between the cathode and the control electrode, an electric field is generated at the cathode that allows electrons to tunnel through a vacuum space and move towards the anode. The field at the cathode, and hence, the quantity of electrons emitted, can be controlled by varying the control electrode potential.

US005463269 discloses an integrated VMD device and a method for making thereof. The integrated VMD device is made by using a fabrication process in which the conformal deposition of an insulator into a aperture produces a symmetric cusp that can be used as a mold to form a pointed or sharp field emission tip. The aperture can be created out of any stable material including layered alternating stacks of conductors and insulators which can act as the electrodes of the finished devices. Two electrodes (anode and emitter) form a simple diode while three, four and five electrodes would form respectively a triode, tetrode, and pentode for example. Since the cusp is self-aligned within the center of the aperture it is also aligned to the center of these electrodes. The cusp is then filled with an electron-emitting material capable of emitting electrons under the influence of an electric field.

The access aperture created in the electron-emitting material allows the removal of the insulator of the cusp forming layer from the aperture and from underneath the emitter material, thus forming a space and freeing the sharp tip of the emitter (field emission cathode) that was molded by the cusp.

However, the realization of the above described Vacuum Microelectronic Device involves high process flow cost and, nevertheless, said VMD could be affected by some problems which may alter the operative features such ionizing radiations and noise at the power output.

BRIEF SUMMARY

One aspect of the present disclosure is to provide a novel structure and a fabrication method of an integrated vacuum microelectronic device which solves the above mentioned problems.

One aspect of the present disclosure is an integrated vacuum microelectronic device comprising:

a highly doped semiconductor substrate, at least one insulating layer placed above said doped semiconductor substrate, a vacuum aperture arranged within said at least one insulating layer and extending to the highly doped semiconductor substrate, a first metal layer placed above said vacuum aperture and acting as a cathode, a second metal layer placed under said highly doped semiconductor substrate and acting as an anode, wherein said first metal layer is placed adjacent to the upper edge of said vacuum aperture, said vacuum aperture having a width dimension such that the first metal layer remains suspended over said vacuum aperture.

BRIEF DESCRIPTION OF THE SEVERAL VIEWS OF THE DRAWINGS

For a better understanding of the present disclosure, some embodiments thereof are now described, purely by way of non-limiting examples and with reference to the annexed drawings, wherein.

DETAILED DESCRIPTION

New technique and structures for the integrated fabrication of a Vacuum Microelectronic Device (VMD) are described. The term VMD or Vacuum Microelectronic device as used herein, means not only a diode but a triode, tetrode, pentode or any other device that is made using the basic structure of the VMD device. The basic structure of the VMD comprises a device comprising at least a sharp emitter (cathode) tip, a collector (anode) with an insulator separating the emitter and the collector and wherein there is a preferably direct transmission of electrons from the emitter to the collector.

Figure 1:
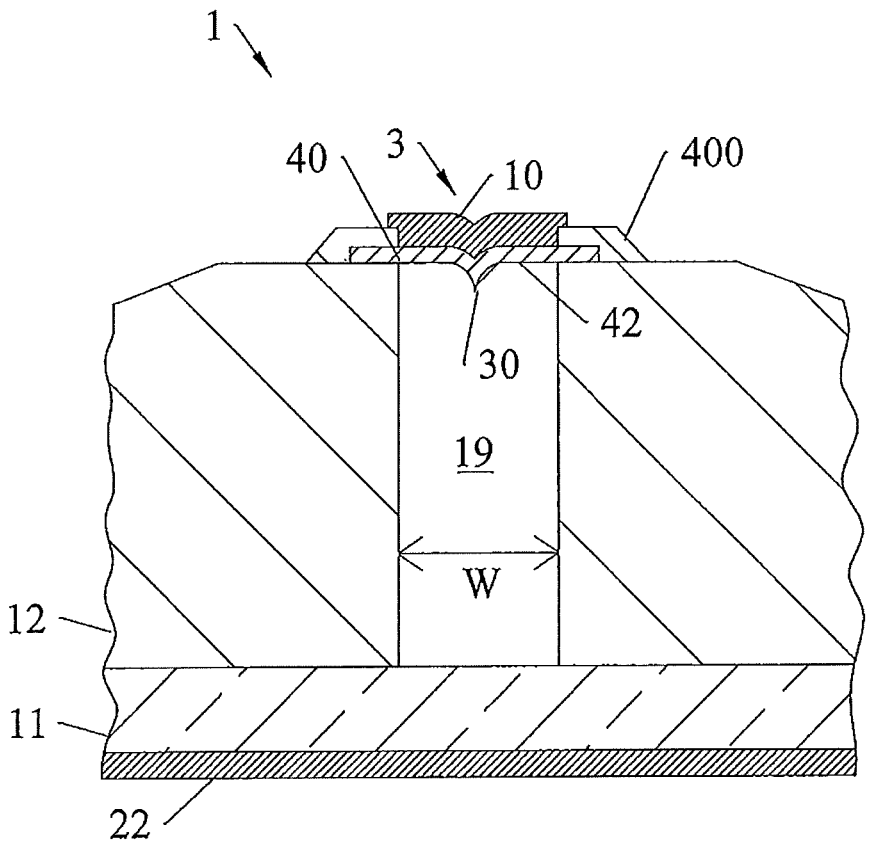
FIG. 1 is a cross-sectional view of VMD according to the a first embodiment of the present disclosure.

FIG. 1 illustrates a cross-sectional view of a VMD 1 according to a first embodiment of the present disclosure. The VMD 1 includes a highly doped semiconductor substrate 11, above which at least one insulating layer 12 of a suitable thickness as to sustain a maximum operating voltage is formed. Preferably the semiconductor substrate 11 is a highly doped n-type semiconductor substrate and preferably the material used for doping the semiconductor substrate 11 is phosphorous and the resistivity of the semiconductor substrate 11 is about 4 mOhm·cm. Preferably the at least one insulating layer 12 is a silicon-dioxide ($SiO_2$) layer.

Other materials that are equally acceptable for the doped semiconductor substrate 11 or the at least one insulating layer 12 could be used and any suitable method of layer formation as are generally practiced throughout the semiconductor industry could be adopted.

Preferably, the at least one insulating layer 12 is formed by means of a known thermal process controlled in temperature (typically comprised between 400° C. and 1100° C.) like, for example, a PECVD deposition (plasma-enhanced chemical vapor deposition) wherein the temperature is comprised between 400° C. and 600° C.

Since the deposition of the insulating layer 12, a vacuum aperture or space 19 is formed within said at least one insulating layer 12. The vacuum space 19 is formed by forming a lithographic mask over the insulating layer and successively effectuating an anisotropic etching on the insulating layer 12 for removing the insulating material of the layer 12 where the vacuum aperture is formed; the anisotropic etching is effectuated until the upper surface of the doped semiconductor substrate 11 is exposed. The shape of the vacuum aperture 19 can be square, round, oval, etc. Preferably the dimension of the width W of the vacuum aperture 19 ranges from 350 nanometers to 550 nanometers.

Preferably the formation of the vacuum aperture or space 19 provides the formation of a masking layer, which is sensitive in a positive or negative sense to some form of actinic radiation, that is deposited on the surface of interest, successively this layer is exposed pattern-wise to the appropriate actinic radiation to selectively remove the masking layer and expose the underlying surface in the patterns desired, successively the exposure surface is anisotropic etched to remove all or part of the underlying material as desired and then the remaining areas of the masking layer are removed.

A non-conformal deposition of a first metal layer 42 over the previously realized structure closes the vacuum aperture 19. Preferably the first metal layer 42 is deposited at low temperature, typically lower than 300° C., so that the speed of deposition is not homogeneous in all the directions, but the horizontal direction is privileged. The first metal layer 42 is placed adjacent to an upper edge 40 of the vacuum aperture 19, preferably adjacent to the upper edge of the upper opening of the vacuum aperture 19, forming protuberances from said upper edge 40 which, growing mostly along the horizontal direction, approach towards the inside of the vacuum aperture, remaining suspended over said vacuum aperture 19, and unite themselves at the end of the deposition step. Said vacuum aperture 19 has a width dimension W such as the first metal layer 42 remains suspended over said vacuum aperture 19; the first metal layer 42 allows sealing the vacuum aperture 19.

The upper edge 40 refers to the edge of the opening of the vacuum aperture 19 which is opened in the upper surface of said at least one insulating layer 12. The depth of the vacuum space 19 is equal to the thickness of the insulating layer 12 for exposing the highly doped semiconductor substrate 11 through the vacuum space 19 while the dimension of the width W of the vacuum space 19, that is the dimension of the cross-section of the vacuum space 19, is suitable to avoid a precipitation of the deposited first metal layer 42 inside the vacuum aperture 19. Preferably the thickness of the deposited first metal layer 42 is suitable to produce a sealing cap; preferably, the thickness of the deposited first metal layer 42 is equal to at least the width W of the vacuum aperture 19 and, in any case, lower than 1 μm.

A RF sputtering deposition technique is typically used for the formation of the first metal layer 42, but other processes can produce acceptable results.

Since said first metal 42 is the last deposition conducted in a vacuum environment, preferably a high vacuum environment, the vacuum aperture 19 will have a vacuum pressure of about $10^{-5}$ Torr, preferably the pressure at the deposition step of the first metal layer 42.

The first metal layer 42 is then lithographically defined, leaving only a suitable central portion which continues to ensure the sealing of the vacuum aperture 19.

The first metal layer 42, being an electron-emitting layer, will act as a cathode during the operation of the VMD 1.

A cathode passivation is then performed through a deposition of a further insulating layer 400, preferably a deposition of the PECVD type. However, any suitable passivation techniques could be adopted, as similarly discussed in the previous process steps.

An opening 3 is then arranged in the insulating layer 400, having a thickness ranging from 100 nm to 200 nm, until a portion of the upper face of the first metal layer 42 is exposed. Said opening is suitable for forming the cathode contact 10 to allow the electrical connection from the top of the finished VMD device 1.

To this purpose a further metal layer is deposited over the now realized structure and in the opening 3. Preferably the deposition of tungsten is followed by a further deposition of aluminum to fully fill the openings 3.

The cathode contact 10 corresponding to the access point for the first metal layer 42 is lithographically defined from said further metal layer.

A back further conductive layer 22 (aluminum, for example) is placed under the highly doped semiconductor substrate 11 to form the anode. Preferably, the back finishing is performed by a grinding and evaporation process.

When an appropriate difference of potential is applied between the electrodes connected to the first metal layer 42 and the further conductive layer 22 (with a positive potential applied at the electrode connected with the first metal layer 42), the cathode allows electrons to tunnel through the vacuum space 19 and move towards the highly doped substrate material 11 and the further conductive layer 22.

Preferably the first metal layer 42 forms a cusp 30 inside the vacuum aperture 19; this improves the emission of electrons from the metal layer 42 inside the vacuum aperture 19 toward the anode.

Two conductive layers (anode 22, 11 and cathode 10, 42) form a simple diode device of the VMD type, while three, four and five layers would form respectively a triode, tetrode, and pentode. Said further conductive layers are called "grid layers" and are interposed between the first metal layer 42 and the second metal layer 22 during the described process flow.

Figure 2:
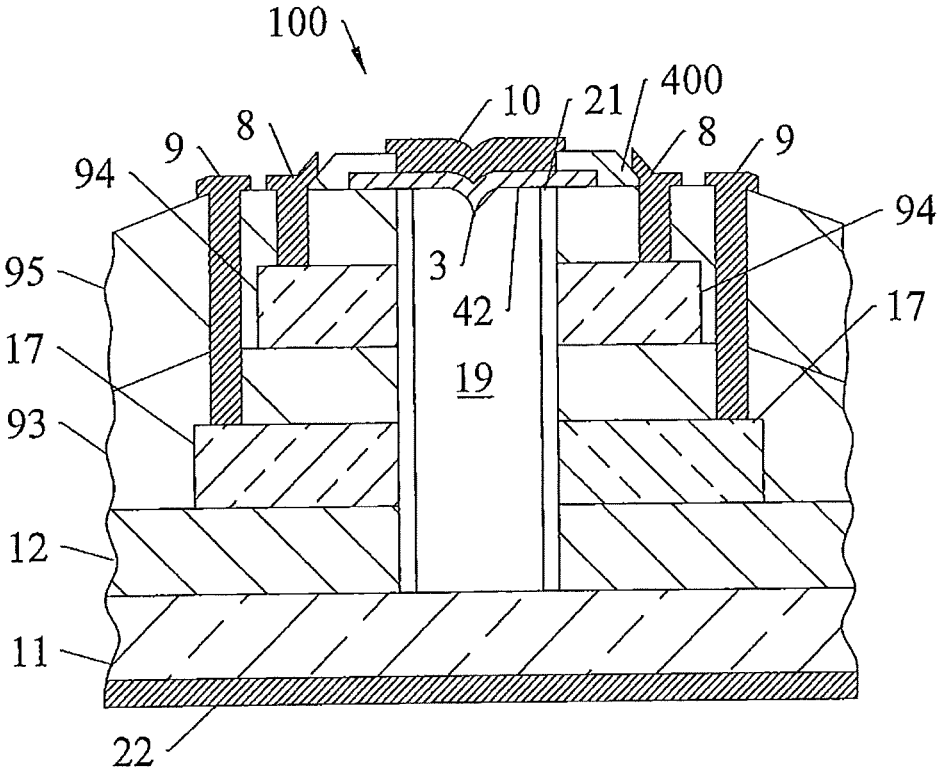
FIG. 2 is a cross-sectional view of a VMD according to the a second embodiment of the present disclosure.
Figure 3:
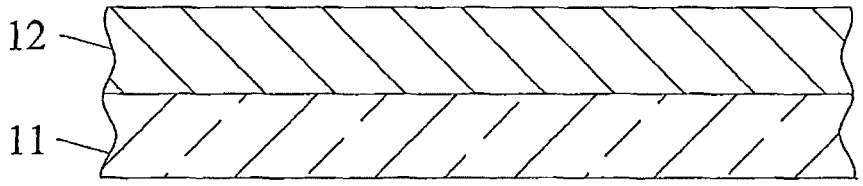
FIG. 3-18 are cross-sectional views of the different process steps to form the VMD according a second embodiment of the present disclosure.

A cross-sectional view of a VMD 100 according to a second embodiment of the present disclosure is shown in FIG. 2. The different process steps to form the VMD 100 are shown in FIGS. 3-18.

The starting structure comprises also in this case the highly doped semiconductor substrate 11 (FIG. 3), above which a first insulating layer 12 is formed.

Preferably the semiconductor substrate 11 is a highly doped n-type semiconductor substrate and preferably the material used for doping the semiconductor substrate 11 is phosphorous and the resistivity of the semiconductor substrate 11 is about 4 mOhm·cm. Preferably the first insulating layer 12 is a silicon-dioxide ($SiO_2$) layer.

Preferably, the at least one insulating layer 12 is formed by means of known thermal processes controlled in temperature (typically comprised between 400° C. and 1100° C.) like, for example, a PECVD deposition (plasma-enhanced chemical vapor deposition) wherein the temperature is comprised between 400° C. and 600° C.

Figure 4:
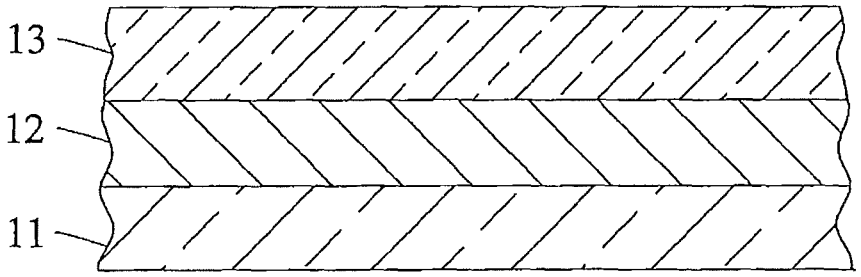

A first conductive layer 13, which could be doped polysilicon, is then deposited on the first insulating layer 12 (FIG. 4). Polysilicon resistivity is determined by used dopant charge which could have values comprised in the range of 10÷100 mΩ*cm. Preferably the thickness of conductive layer 13 is comprised between 300 nm and 500 nm and said layer 13 is preferably deposited through LTCVD deposition (low-temperature chemical vapor deposition). However, other suitable conductive electric material could be used to form the layer 13.

Figure 5:
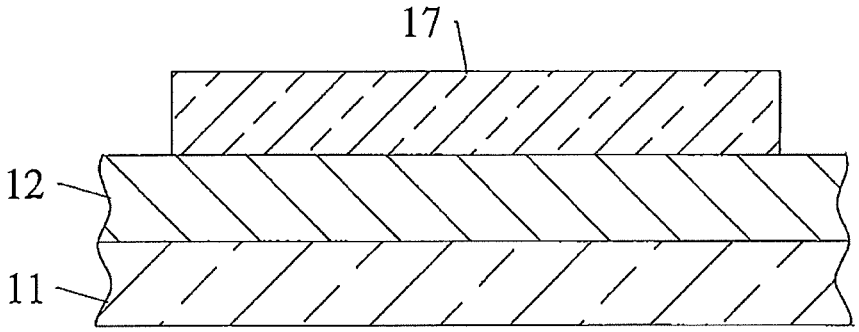
Figure 6:
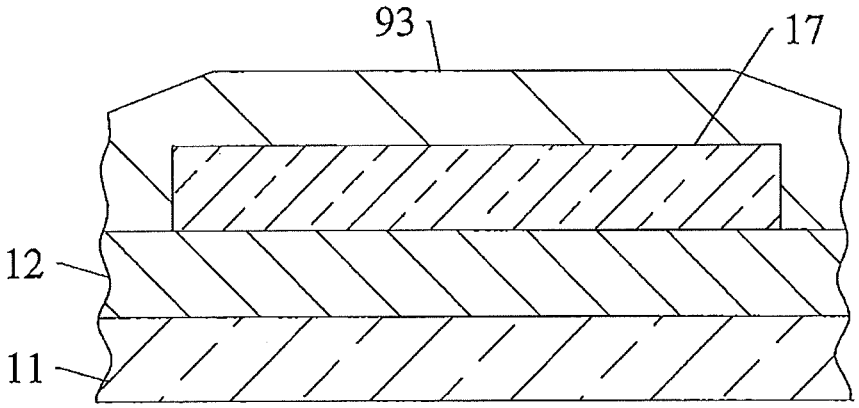

A first grid conductor 17 is then lithographically defined from the conductive layer 13 as is shown in FIG. 5. In the next step a first grid insulating layer 93 is grown above the patterned grid conductor 17 (FIG. 6). Any material which has electrical insulation properties could be used for the first grid insulating layer 93, like, for example a silicon-dioxide ($SiO_2$) of a typical thickness of 100÷200 nm. Preferably, a PECVD deposition is used even if any suitable techniques could be adopted.

Figure 7:
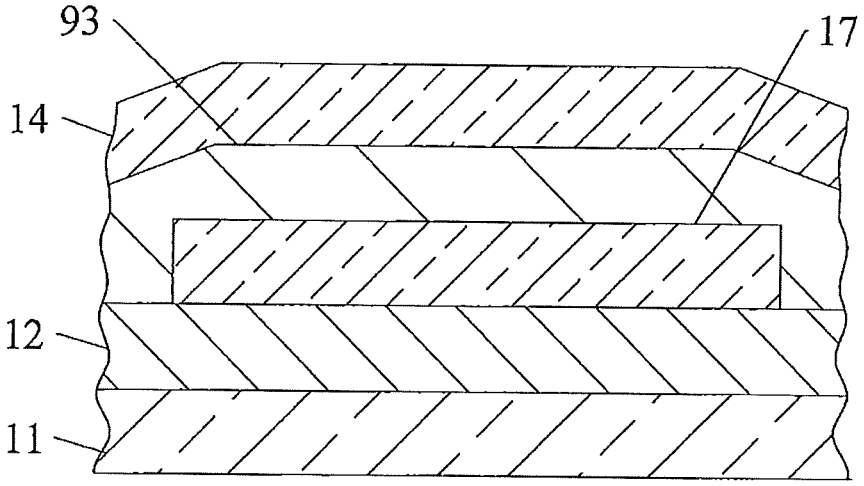
Figure 8:
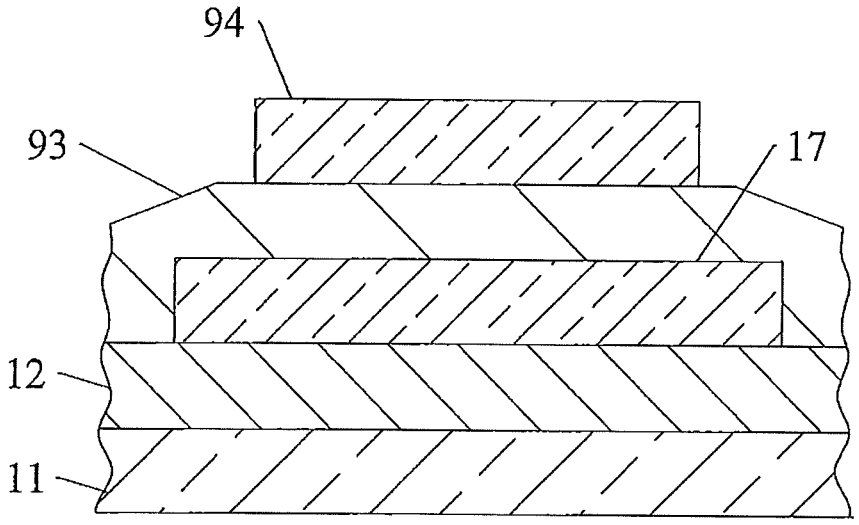
Figure 9:
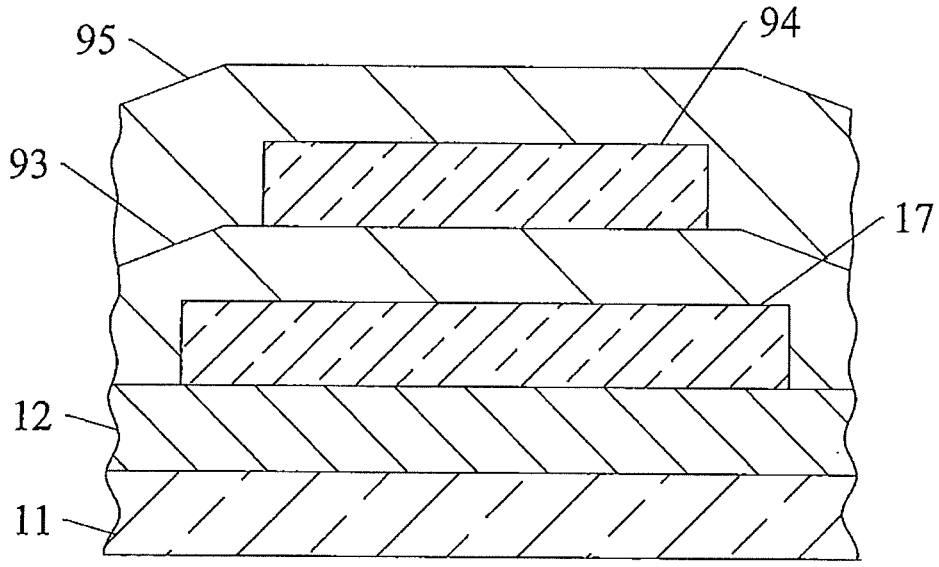

The last three steps could be repeated for realizing layered alternating stacks of grid conductors and grid insulators which will form the electrodes in the finished VMD device 100. In this case, above said first grid insulating layer 93 a second grid conductor 94 is lithographically defined from a second conductive layer 14 and then a second grid insulator layer 95 is deposited (FIG. 7-9). However, further layered alternating stacks of conductors and insulator could be made to obtain more electrodes in the finished VMD 100.

Figure 10:
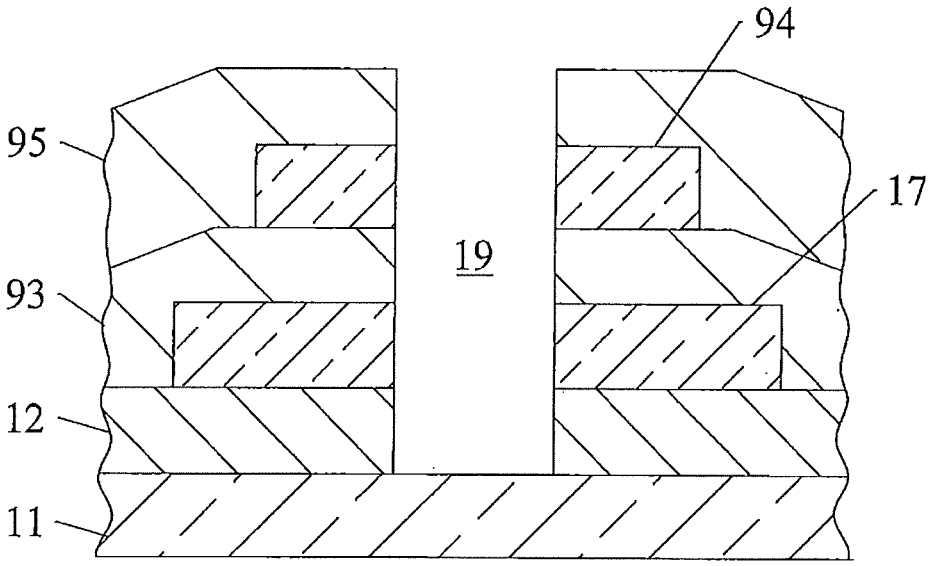

The next step is the formation of a vacuum aperture 19 at a centered portion of area below which both the first 17 and the second 94 grid conductors are present, as shown in FIG. 10. The vacuum space 19 is formed by forming a lithographic mask over the insulating layer 95 and successively effectuating an anisotropic etching on the layer 95 and the layers arranged under the insulating layer 95, that is the layers 94, 93, 17 and 12, for removing the insulating and polysilicon material of said layers where the vacuum aperture is to be formed; the anisotropic etching is effectuated until the upper surface of the doped semiconductor substrate 11 is exposed. The shape of the vacuum aperture 19 can be square, round, oval, etc.

Preferably the formation of the vacuum aperture or space 19 provides the formation of a masking layer that is sensitive in a positive or negative sense to some form of actinic radiation is deposited on the surface of interest, successively this layer is exposed pattern-wise to the appropriate actinic radiation to selectively remove the masking layer and expose the underlying surface in the patterns required, successively the exposure surface is anisotropic etched to remove all or part of the underlying material as desired and then the remaining areas of the masking layer are removed.

Figure 11:
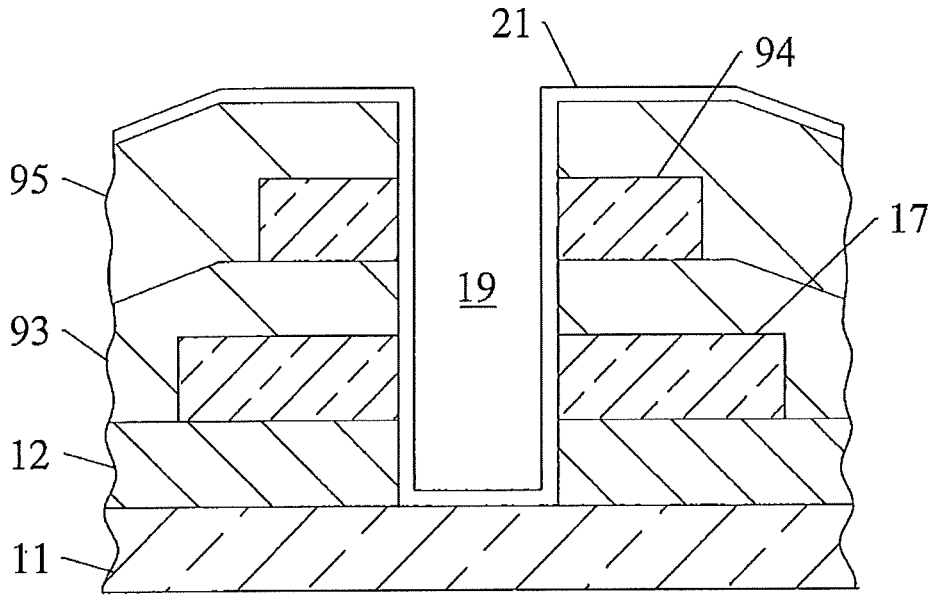

Preferably a second insulating layer 21 of a lower thickness (typically ranging from 50 nm to 100 nm) is then conformally deposited over the previously realized structure, to cover even the internal walls of the vacuum space 19 (FIG. 11). Preferably, the second insulating layer 21 could be a silicon-nitride ($Si_3N_4$) which can be formed, through known methods which ensure a layer thickness homogeneous in all the directions like, for example, to a PECVD deposition.

Figure 12:
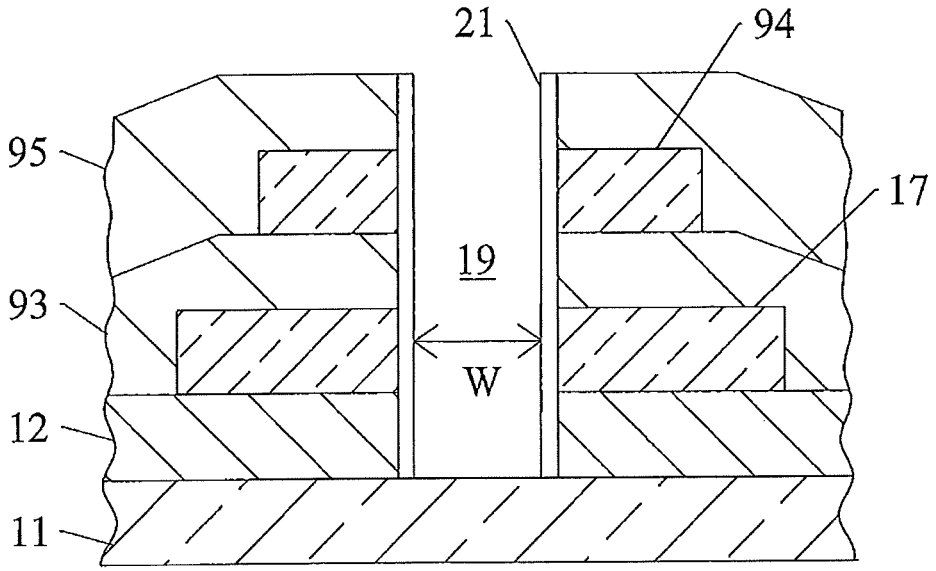

The second insulating layer 21 is then defined leaving the second insulating layer 21 only on the sidewalls of the vacuum space 19 (FIG. 12). Advantageously, the selective etching is a dry select or anisotropic etching with no masks usage. The insulating layer 21 allows insolating the vacuum space 19 from the grid conductors 94 and 17. Preferably the dimension of the width W of the vacuum aperture 19, after the formation insulating layer 21 only on the sidewalls of the vacuum space 19, ranging from 350 nanometers to 550 nanometers.

The two grid conductors 17, 94 now surround the vacuum aperture 19 and will act as electrodes in the finished VMD 100 (FIG. 2). Through the applications of suitable values of voltage, said electrodes 17, 94 will drive the electron emission of the VMD 100.

Figure 13:
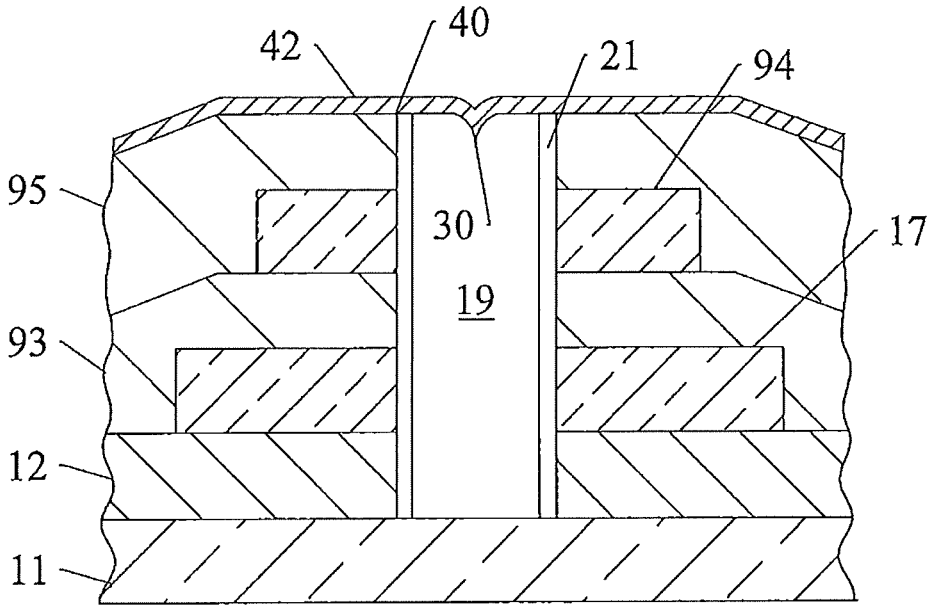
Figure 14:
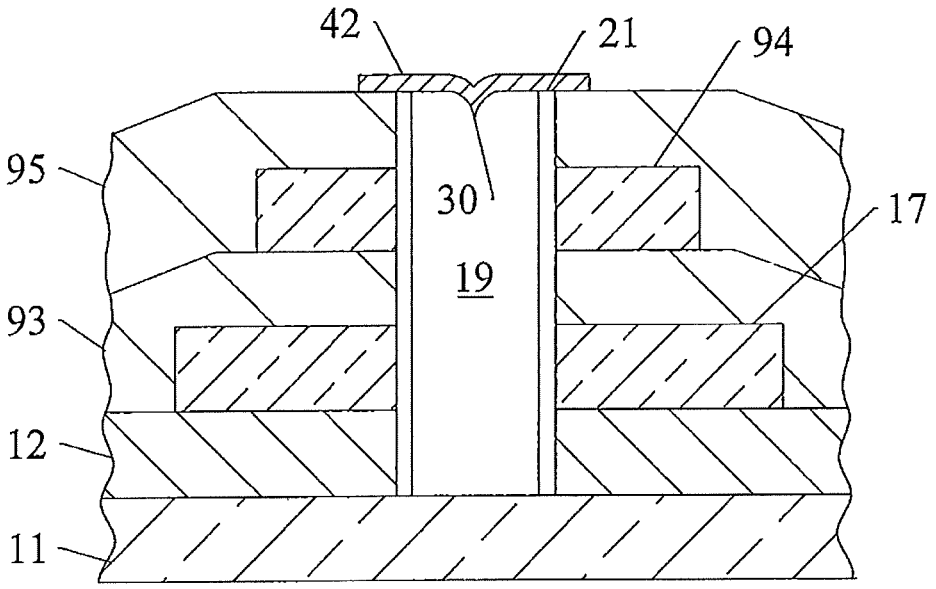

A non-conformal deposition of a first metal layer 42 over the previously realized structure closes the vacuum aperture 19 (FIG. 13). Preferably the first metal layer 42 is deposited at low temperature, typically lower than 300° C., so that the speed of deposition is not homogeneous in all the directions, but privileged horizontally. The first metal layer 42 is placed adjacent to an upper edge 40 of the vacuum aperture 19, preferably adjacent to the upper edge of the upper opening of the vacuum aperture 19, forming protuberances from said upper edge 40 which, growing mostly horizontally, approach towards the inside of the vacuum aperture, remaining suspended over said vacuum aperture 19, and unite themselves at the end of the deposition process. Said vacuum aperture 19 has a width dimension W such as the first metal layer 42 remains suspended over said vacuum aperture 19; the first metal layer 42 allows sealing the vacuum aperture 19.

The upper edge 40 refers to the edge of the opening of the vacuum aperture 19 which is opened in the upper surface of the insulating layer 95. The depth of the vacuum space 19 is equal to thickness of all the layers 95, 94, 93, 17, 12 for exposing the doped semiconductor substrate 11 through the vacuum space 19 while the dimension of the width W of the vacuum space 19, that is the dimension of the cross-section of the vacuum space 19, is suitable to avoid a precipitation of the deposited first metal layer 42 inside the vacuum aperture 19. Preferably the thickness of the deposited first metal layer 42 is suitable to produce a sealing cap; preferably, the thickness of the deposited first metal layer 42 is equal to at least the width W of the vacuum aperture 19 and, in any case, lower than 1 μm.

A RF sputtering deposition technique is typically used for the formation of the first metal layer 42, but other processes can produce acceptable results.

Since said first metal 42 is the last deposition conduced in a vacuum environment, preferably a high vacuum environment, the vacuum aperture 19 will have a vacuum pressure of about $10^{-5}$ Torr, preferably the pressure at the deposition step of the first metal layer 42.

The first metal layer 42 is then lithographically defined (FIG. 14), leaving only a suitable central portion which continue to ensure the sealing of the vacuum aperture 19.

The first metal layer 42, being an electron-emitting layer, will act as a cathode during the operation of the VMD 100.

Preferably the first metal layer 42 forms a cusp 30 inside the vacuum aperture 19; this improves the emission of electrons from the metal layer 42 inside the vacuum aperture 19 toward the anode.

Figure 15:
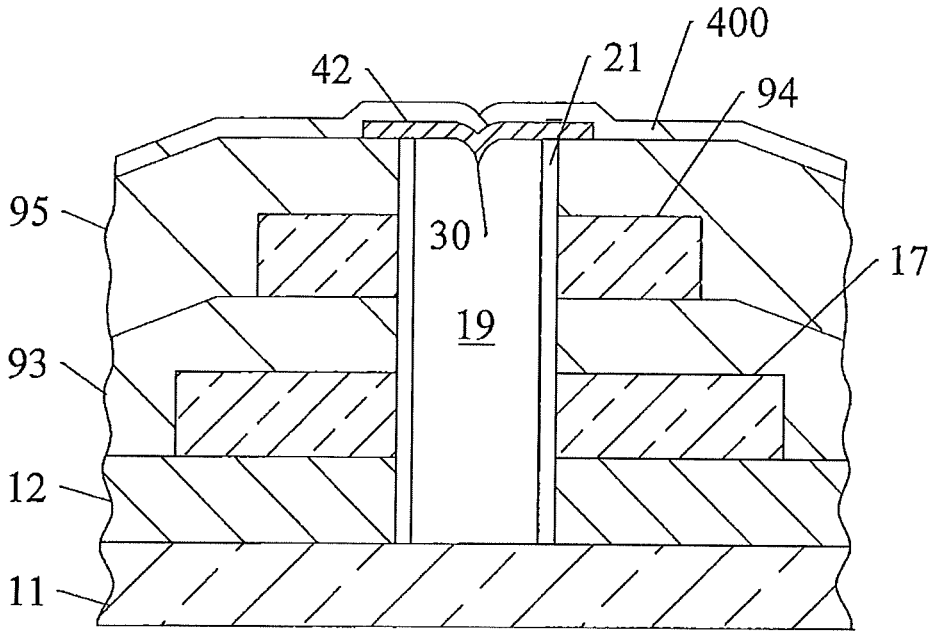

A cathode passivation is then performed through a further insulating layer 400 deposition process like, for example, a PECVD deposition (FIG. 15). However, any suitable passivation techniques could be adopted, as similarly discussed in the previous process steps.

Figure 16:
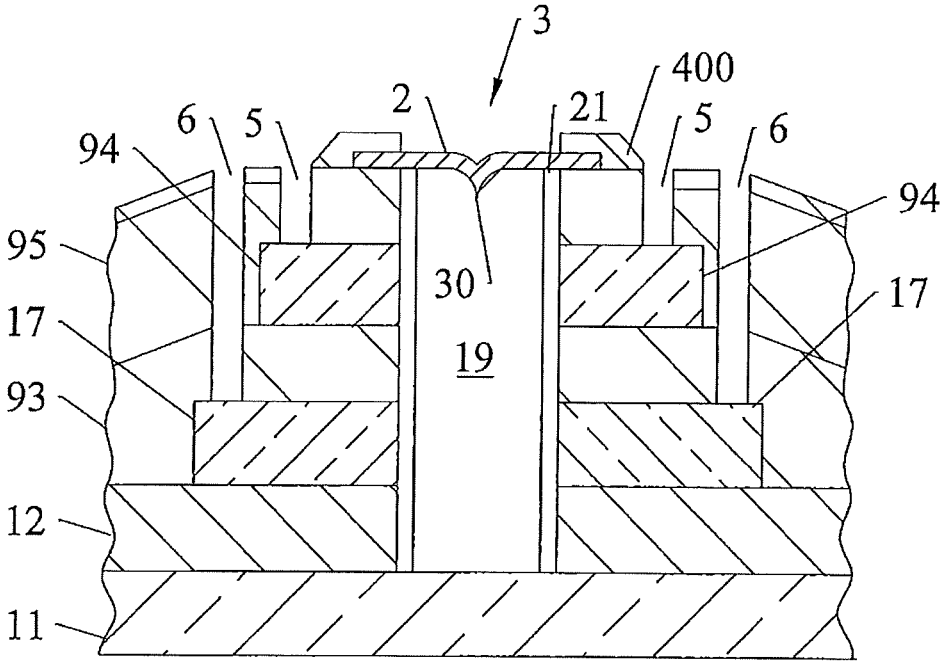

An opening 3 is then lithographically defined on the insulating layer 400, having a thickness ranging from 100 nm to 200 nm, and the insulating material is etched and removed so that a portion of the upper face of the first metal layer 42 is exposed (FIG. 16). Said opening is suitable for forming the cathode contact 10 to allow the electrical connection from the top of the finished VMD device 100.

A plurality of openings 5, 6 are lithographically defined in the insulating layer 400 together with the opening 3 (FIG. 16), preferably the openings 5 and 6 have a ring shape. The insulating materials of the stacked insulating layers 93, 95, 400 within the openings 5, 6 are then etched during the etching and removing step for the opening 3 (FIG. 16) to reach the upper face of each grid layers 94, 17. Said openings 5, 6 being suitable for forming a plurality of metal ways to allow the connection, from the top of the finished VMD 100, to the lower conductive grid layers 94, 17.

Figure 17:
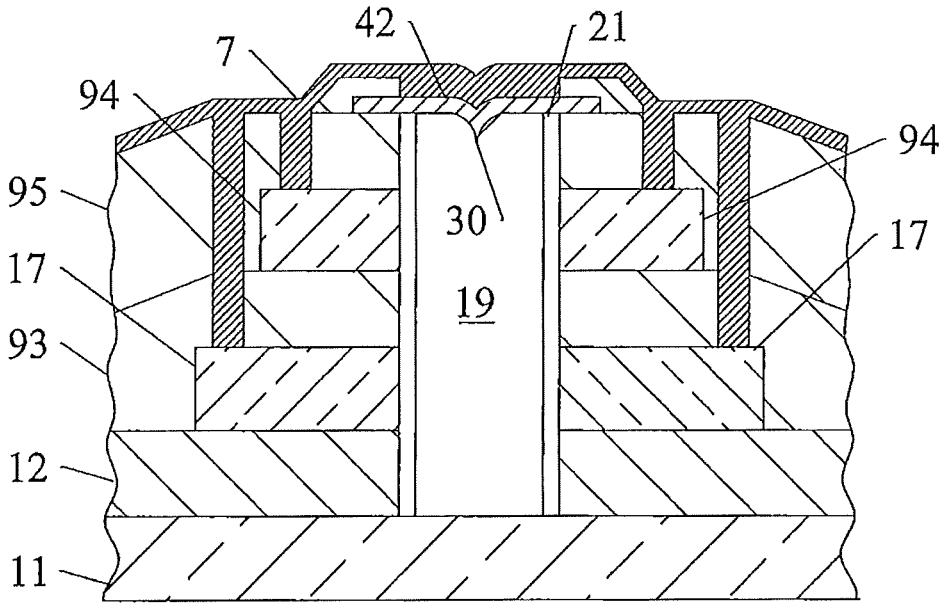

Then a further metal layer, for example tungsten, is deposited over the now realized structure and in the openings 3, 5 and 6 (FIG. 17). Preferably the deposition of tungsten is followed by a further deposition of aluminum to fully fill the openings 3, 5, 6.

Figure 18:
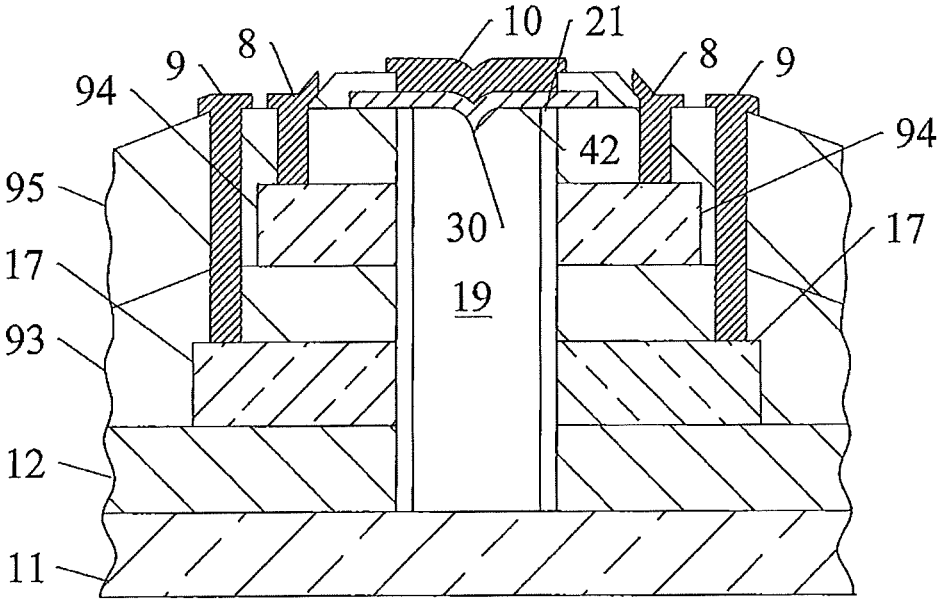

The cathode contact 10 corresponding to the access point for the first metal layer 42 and the electrode contacts 8, 9 for contacting the respective conductive layers 94, 17 are lithographically defined in said further metal layer by forming suitable openings and etching a removing portion of the further metal layer (FIG. 18).

Finally, a back further conductive layer 22 (aluminum, for example) is placed under the doped semiconductor substrate 11, forming a contact which will act as an anode of the VMD 100 (FIG. 2). Preferably, the back finishing is performed by grinding and evaporation process.

When an appropriate difference of potential is applied between the electrodes connected to the first metal layer 42 and the further conductive layer 22 (with a positive potential applied at the electrode connected with the first metal layer 42), the cathode allows electrons to tunnel through the vacuum space 19 and move towards the high doped substrate material 11 and the further conductive layer 22.

Figure 19:
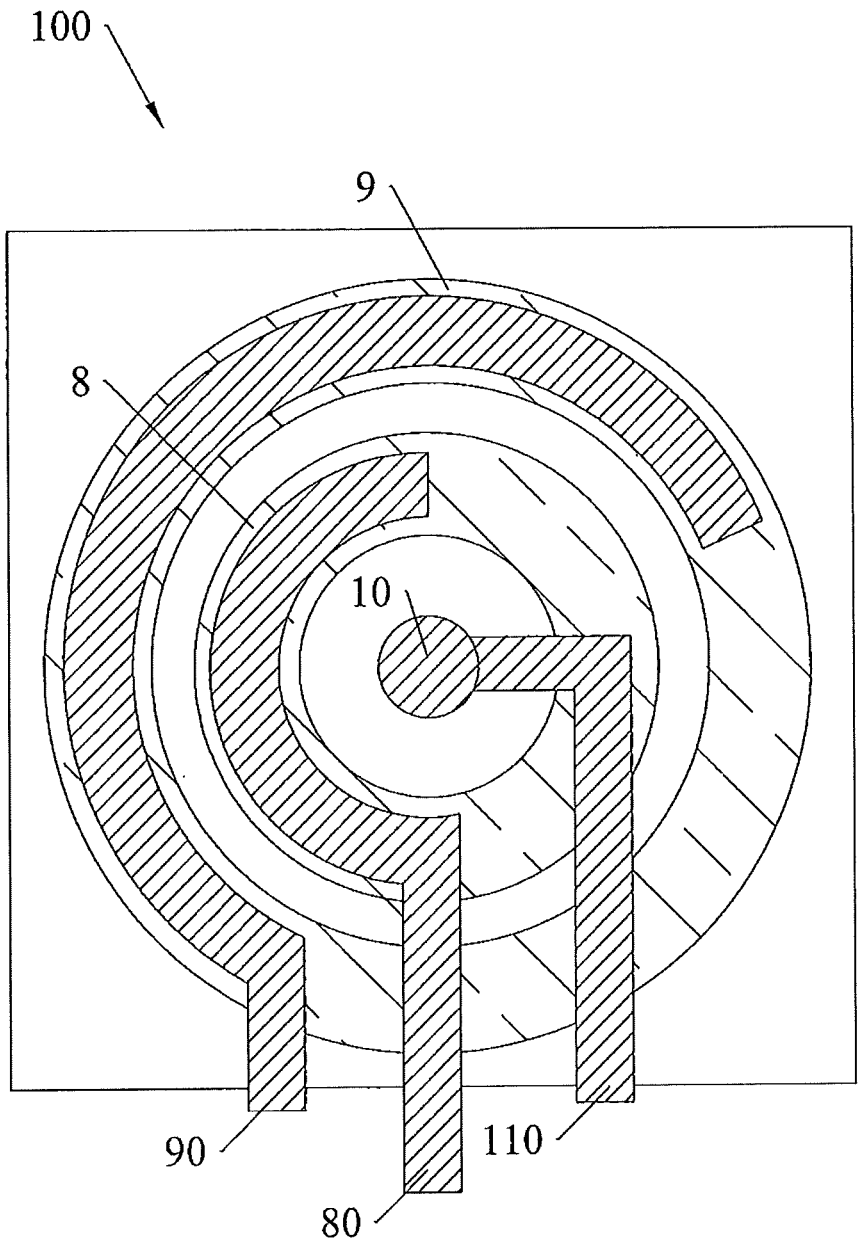
FIG. 19 shows a layout of the VMD according to the a second embodiment of the present disclosure in the case wherein the VMD is a tetrode.

FIG. 19 shows a layout of the VMD 100 of FIG. 2 in the case wherein the VMD 100 is configured as a tetrode. Metal paths 80, 90 and 110 are formed to contact respectively the cathode 10 and the metal layers 9 and 8 respectively on the conductive grid layers 94 and 17 for electrically acting on the cathode (for changing the electron emission) and on the conductive grid layers 94 and 17 (for changing the electrical field to which the vacuum aperture 19 is subjected). The metal path 80 extends for about the 50% of the ring opening 5 wherein the metal layer 8 is deposited while the metal path 90 extends for more than the 50% of the ring opening 6 where the metal layer 9 is deposited; the metal path 110 extends across the aperture opening 3 where the metal 10 is deposited.

Figure 20:
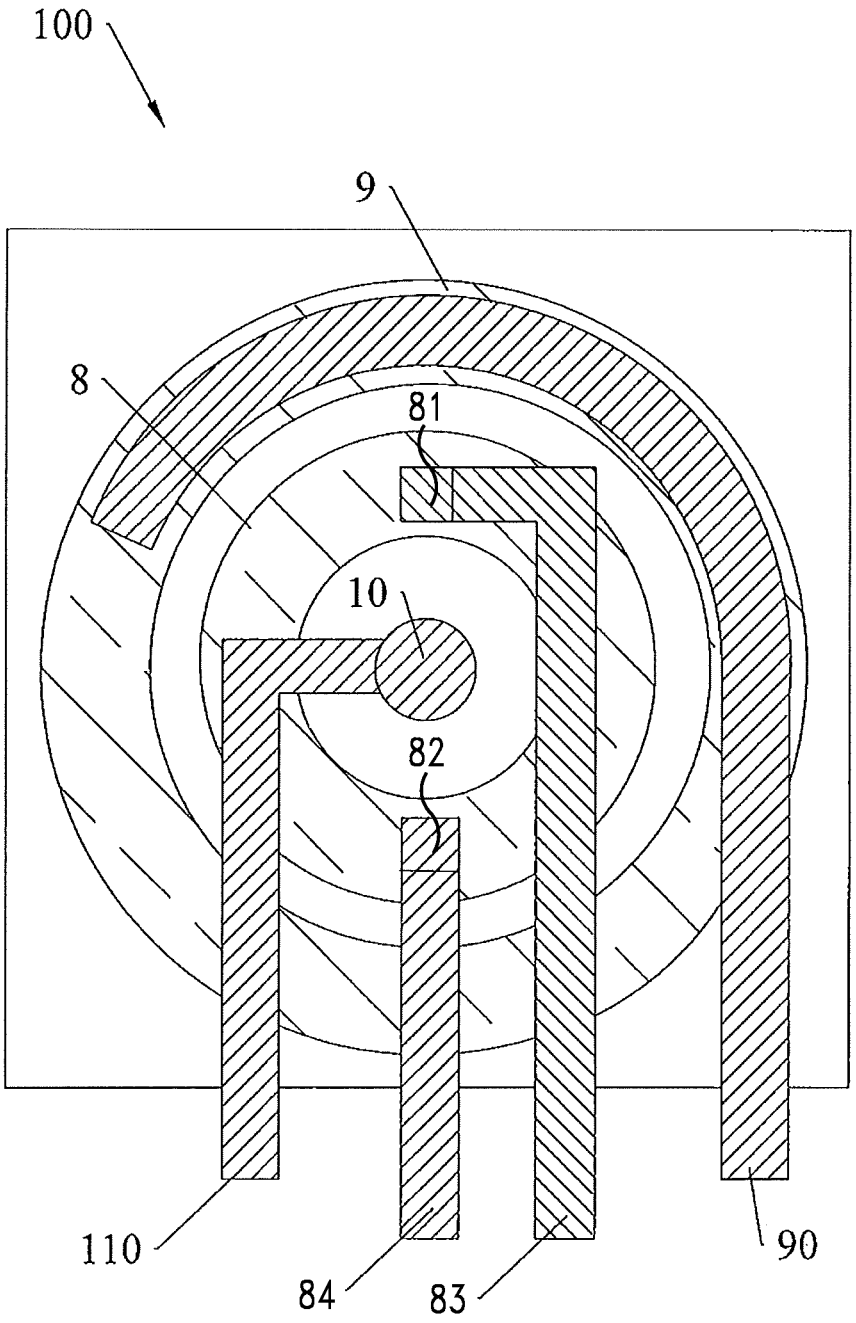
FIG. 20 shows another layout of a VMD according to the a second embodiment of the present disclosure in the case wherein the VMD is a hot triode.

FIG. 20 shows a layout of the VMD 100 of FIG. 2 in the case wherein the VMD 100 is configured as a hot triode. Metal paths 90 and 110 are formed to contact respectively the metal layer 9 on the polysilicon layer 17 and the cathode 10, for electrically acting on the cathode 10 (for changing the electron emission) and on the polysilicon layer 17 (for changing the electrical field to which the vacuum aperture 19 is subjected). Differently from the layout in FIG. 19, the metal layer 8 on the conductive grid layer 94 is contacted at two different points 81, 82 by respective metal paths 83, 84, with the contact point 81 opposite to the contact point 82 along the ring opening 5 filled with the metal layer 8, to connect the respective metal paths 81 and 82 to one metal heater. In fact, polarizing said two contact metals 81, 82 a current will flow and the conductive grid layer 94 which, acting as a resistive heater, will heat by Joule effect.

Figure 21:
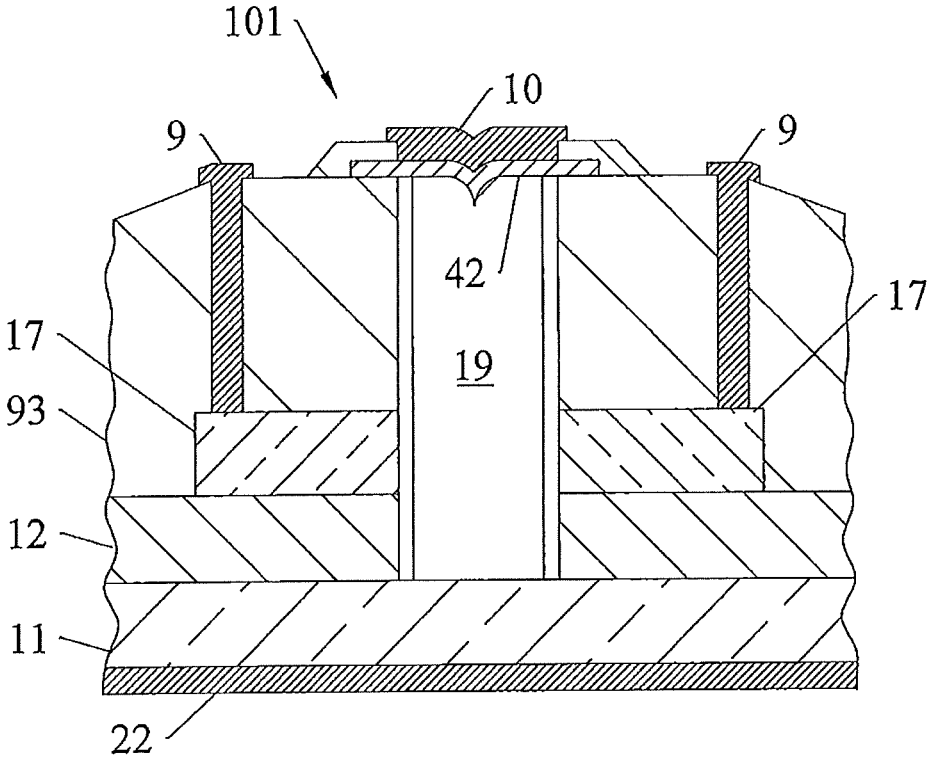
FIG. 21 is a cross-sectional of a VMD according to the a third embodiment of the present disclosure.

A cross-sectional view of a VMD 101 according to a third embodiment of the present disclosure is shown in FIG. 21. The VMD 101 differs from the VMD 100 in FIG. 2 for the absence of the conductive grid 94 and the insulating layer 95. Only the opening 6 is formed to allow the contact of the conductive grid layer 17 by means of the metal layer 9.

Figure 22:
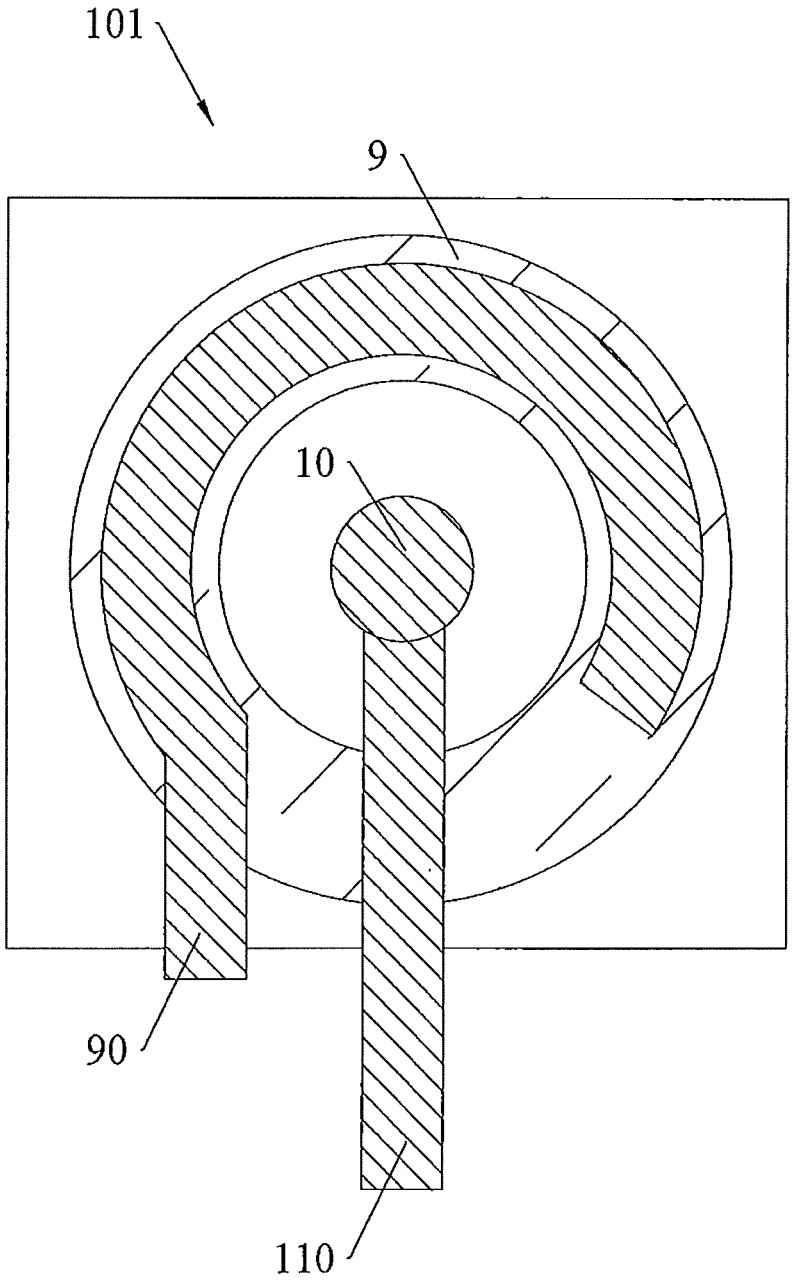
FIG. 22 shows a layout of the VMD in FIG. 21.

As shown in FIG. 22, the layout of the VMD 101 comprises metal paths 90 and 110 which are formed to contact respectively the cathode 10 and the conductive grid layer 17 for electrically acting on the cathode (for changing the electron emission) and on the conductive grid layer 17 (for changing the electrical field to which the vacuum aperture 19 is subjected). The metal path 90 extends for more than the 50% of the ring opening 6 where the metal layer 9 is deposited; the metal path 110 extends for the aperture opening 3 where the metal 10 is deposited.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An integrated vacuum microelectronic device comprising:

a doped semiconductor substrate, at least one insulating layer placed above said doped semiconductor substrate, a vacuum aperture formed within said at least one insulating layer and extending to the doped semiconductor substrate, a first metal layer placed above said vacuum aperture and configured to act as a cathode, and a second metal layer placed under said doped semiconductor substrate and configured to act as an anode, wherein said first metal layer is placed adjacent to an upper edge of said vacuum aperture, said vacuum aperture having a width dimension such that the first metal layer remains suspended over and seals said vacuum aperture.

2. The integrated vacuum microelectronic device according to claim 1, wherein said at least one insulating layer comprises two or more insulating layers of a stack that includes one or more conductive layers separating the two or more insulating layers from each other, said vacuum aperture is formed within said stack, the integrated vacuum microelectronic device comprising one or more electrodes contacting the one or more conductive layers of the stack.

3. The integrated vacuum microelectronic device according to claim 2, comprising a further insulating layer placed on sidewalls of the vacuum aperture.

4. The integrated vacuum microelectronic device according to claim 3, wherein said further insulating layer is made of silicon-nitride and has a thickness ranging from 50 to 100 nm.

5. The integrated vacuum microelectronic device according to claim 2, wherein said one or more conductive layers are made of doped polysilicon, having a thickness between 300 nm and 500 nm and a resistivity ranging from 10 to 100 mΩ·cm.

6. The integrated vacuum microelectronic device according to claim 2, wherein the at least one insulating layer includes three insulating layers, the device further comprising:

two conductive layers separating the three insulating layers from each other; the two conductive layers including a conductive grid layer; and first and second metal paths electrically coupled to the conductive grid layer at two different contact points, the conductive grid layer being configured to act as a metal heater between the contact points.

7. The integrated vacuum microelectronic device according to claim 1, wherein said vacuum aperture has a width dimension ranging from 350 nm to 550 nm.

8. The integrated vacuum microelectronic device according to claim 1, wherein the vacuum aperture has a vacuum at a pressure of about $10^{-5}$ Torr.

9. The integrated vacuum microelectronic device according to claim 1, wherein said first metal layer has a thickness equal to at least a width dimension of the vacuum aperture.

10. A method for manufacturing an integrated vacuum microelectronic device, comprising:

forming a doped semiconductor substrate;

depositing at least one insulating layer over said doped semiconductor substrate, forming a vacuum aperture within said at least one insulating layer, the vacuum aperture extending to the doped semiconductor substrate, depositing a first metal layer over said vacuum aperture, said first metal layer being configured to act as a cathode, forming a second metal layer under said doped semiconductor substrate, said second metal layer being configured to act as an anode, wherein said first metal layer is placed adjacent to an upper edge of said vacuum aperture, said vacuum aperture having a width dimension such that the first metal layer remains suspended over and seals said vacuum aperture.

11. The method according to claim 10, wherein depositing the at least one insulating layer includes forming two or more insulating layers of a stack and forming said vacuum aperture includes forming the vacuum aperture within said stack, the method comprising:

forming one or more conductive layers separating the two or more insulating layers from each other; and forming one or more electrodes electrically contacting the conductive layers of the stack.

12. The method according to claim 11, comprising, before depositing the first metal layer, depositing a further insulating layer over the stack, selectively removing said further insulating layer until said further insulating layer is only positioned on sidewalls of said vacuum aperture.

13. The method according to claim 12, wherein said further insulating layer is made of silicon-nitride and has a thickness ranging from 50 nm to 100 nm.

14. The method according to claim 11, wherein said one or more conductive layers are made of polysilicon, having a thickness comprised between 300 nm and 500 nm and a resistivity ranging from 10 to 100 mΩ·cm.

15. The method according to claim 10, wherein said vacuum aperture has a width dimension ranging from 350 nm to 550 nm.

16. A method according to claim 10, wherein the vacuum aperture has a vacuum at a pressure of about $10^{-5}$ Torr.

17. A method according to claim 10, wherein depositing the first metal layer occurs at a sufficiently low temperature that enables the first metal layer to be deposited faster in a horizontal direction than in other directions, and depositing the first metal layer forms protuberances extending from said upper edge towards the inside of the vacuum aperture, remaining suspended over said vacuum aperture, and uniting themselves.

18. The method according to claim 10, wherein the said first metal layer has a thickness equal to at least a width dimension of the vacuum aperture.

19. An integrated vacuum microelectronic device comprising:

a doped semiconductor substrate, a stack placed above said doped semiconductor substrate and including three insulating layers and two conductive layers separating the three insulating layers from each other; the two conductive layers including a conductive grid layer, a vacuum aperture formed within said stack and within said insulating layers and extending to the doped semiconductor substrate, a first metal layer placed above said vacuum aperture and configured to act as a cathode, a second metal layer placed under said doped semiconductor substrate and configured to act as an anode, one or more electrodes contacting the one or more conductive layers of the stack, and first and second metal paths electrically coupled to the conductive grid layer at two different contact points, the conductive grid layer being configured to act as a metal heater between the contact points, wherein said first metal layer is placed adjacent to an upper edge of said vacuum aperture, said vacuum aperture having a width dimension such that the first metal layer remains suspended over said vacuum aperture.

20. The integrated vacuum microelectronic device according to claim 19, comprising a further insulating layer placed on sidewalls of the vacuum aperture.

21. The integrated vacuum microelectronic device according to claim 19, wherein said first metal layer has a thickness equal to at least a width dimension of the vacuum aperture.

22. A method for manufacturing an integrated vacuum microelectronic device, comprising:

forming a doped semiconductor substrate;

depositing at least one insulating layer over said doped semiconductor substrate, forming a vacuum aperture within said at least one insulating layer, the vacuum aperture extending to the doped semiconductor substrate, depositing a first metal layer over said vacuum aperture, said first metal layer being configured to act as a cathode, forming a second metal layer under said doped semiconductor substrate, said second metal layer being configured to act as an anode, wherein:

said first metal layer is placed adjacent to an upper edge of said vacuum aperture, said vacuum aperture having a width dimension such that the first metal layer remains suspended over said vacuum aperture, and depositing the first metal layer occurs at a sufficiently low temperature that enables the first metal layer to be deposited faster in a horizontal direction than in other directions, and depositing the first metal layer forms protuberances extending from said upper edge towards the inside of the vacuum aperture, remaining suspended over said vacuum aperture, and uniting themselves.

23. The method according to claim 22, wherein depositing the at least one insulating layer includes forming two or more insulating layers of a stack and forming said vacuum aperture includes forming the vacuum aperture within said stack, the method comprising:

forming one or more conductive layers separating the two or more insulating layers from each other; and forming one or more electrodes electrically contacting the conductive layers of the stack.

24. The method according to claim 23, comprising, before depositing the first metal layer, depositing a further insulating layer over the stack, selectively removing said further insulating layer until said further insulating layer is only positioned on sidewalls of said vacuum aperture.

* * * * *